US008512523B2

(12) United States Patent
Banerjee

(10) Patent No.: US 8,512,523 B2
(45) Date of Patent: Aug. 20, 2013

(54) METHOD FOR ALTERING THE TACK OF MATERIALS

(75) Inventor: Sujit Banerjee, Marietta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 1059 days.

(21) Appl. No.: 11/815,005

(22) PCT Filed: Feb. 14, 2006

(86) PCT No.: PCT/US2006/005082
§ 371 (c)(1),
(2), (4) Date: Jul. 27, 2007

(87) PCT Pub. No.: WO2006/088818
PCT Pub. Date: Aug. 24, 2006

(65) Prior Publication Data

US 2008/0149288 A1 Jun. 26, 2008

(51) Int. Cl.
*D21H 11/00* (2006.01)

(52) U.S. Cl.
USPC ..... 162/182

(58) Field of Classification Search
USPC ..... 162/182
See application file for complete search history.

(56) References Cited

U.S. PATENT DOCUMENTS

| | | | | |
|---|---|---|---|---|
| 3,426,011 | A * | 2/1969 | Parmerter et al. | 536/103 |
| 3,453,257 | A | 7/1969 | Parmerter et al. | |
| 4,443,323 | A | 4/1984 | Horikoshi et al. | |
| 4,724,045 | A | 2/1988 | Ackel | |
| 4,781,794 | A | 11/1988 | Moreland | |
| 4,956,051 | A | 9/1990 | Moreland | |
| 5,098,793 | A | 3/1992 | Rohrbach et al. | |
| 5,155,219 | A | 10/1992 | Kim et al. | |
| 5,626,718 | A | 5/1997 | Philippe et al. | |
| 5,776,842 | A * | 7/1998 | Wood et al. | 442/394 |
| 5,846,433 | A | 12/1998 | Sorensen et al. | |
| 6,103,064 | A | 8/2000 | Asplund et al. | |

(Continued)

FOREIGN PATENT DOCUMENTS

| | | | |
|---|---|---|---|
| EP | 0251132 | A1 * | 1/1988 |
| EP | 0599440 | A1 | 1/1994 |
| JP | H11-116410 | | 4/1999 |
| WO | 2006014563 | A2 | 2/2006 |

OTHER PUBLICATIONS

Abraham, "Successful Approaches in Avoiding Stickies, Recycling," Tappi Journal 81(2): pp. 79-84 (1998).

(Continued)

*Primary Examiner* — Eric Hug
*Assistant Examiner* — Jacob Thomas Minskey
(74) *Attorney, Agent, or Firm* — Sutherland Asbill & Brennan LLP

(57) ABSTRACT

Methods are provided for altering the tack of an adhesive material by contacting the adhesive material with an amount of a cyclodextrin compound effective to reduce the tack of the adhesive material. In a preferred embodiment, the method is for altering the tack of adhesive contaminants in a process fluid, which includes the steps of providing a process fluid in which are dispersed contaminant particles which comprises one or more adhesive materials (such as pitch, pressure sensitive adhesives, hot melts, latexes, binders, and combinations thereof); and adding to the process an amount of a cyclodextrin compound effective to reduce the tack of the adhesive material. The process fluid can be in a process stream in a pulp and paper mill.

15 Claims, 2 Drawing Sheets

(56) References Cited

U.S. PATENT DOCUMENTS

| | | | | |
|---|---|---|---|---|
| 6,210,526 | B1 * | 4/2001 | Pohlen | 162/4 |
| 6,521,134 | B1 | 2/2003 | Banerjee et al. | |
| 6,551,607 | B1 * | 4/2003 | Minerath et al. | 424/402 |
| 6,808,636 | B2 | 10/2004 | Ward et al. | |
| 6,977,027 | B2 | 12/2005 | Sharma et al. | |
| 2002/0172656 | A1 | 11/2002 | Biedermann et al. | |
| 2003/0146172 | A1 | 8/2003 | Brusseau et al. | |
| 2005/0252628 | A1 * | 11/2005 | Day et al. | 162/158 |
| 2006/0124266 | A1 * | 6/2006 | Xu et al. | 162/199 |
| 2008/0041541 | A1 * | 2/2008 | DeLozier et al. | 162/5 |

OTHER PUBLICATIONS

Banerjee, et al., "Evaluating the Effectiveness of Chemicals for Stickies Control," Institute of Paper Science and Technology, Tappi Journal, pp. 1-7 (2000).

"Cyclodextrin News," Chemical Reviews, 98(5): pp. 1751-1753 (1998).

Douek, et al., "Survey of Deposits and Contaminants in Mills Using Recycled Fiber," Progress in Paper Recycling, 13(1): pp. 12-22 (2003).

Hashimoto, et al., "Wet-end Properties of Cationic Graft Terpolymerized Polyacrylamides," The Japan Wood Research Society, pp. 50:271-274 (2004).

Hutten, et al., "Interactions Among Stickies, Fiber, and Water," Institute of Paper Science and Technology, Tappi Journal pp. 1-12 (1995).

Jones, "factiva," Dow Jones & Reuters, pp. 1-4 (2005).

Koskinen, et al., "A Sensor for Microstickies," Recycling, pp. 1-9.

Pelton, et al., "Flocculation of Polystyrene Latex with Mixtures of Poly (p-vinylphenol) and Poly(ethylene oxide)," Langmuir, 12: pp. 5756-5762 (1996).

Szejtli, "Introduction and General Overview of Cyclodextrin Chemistry," Chemical Reviews, 98: pp. 1743-1750 (1998).

Xiao, et al., "Cationic-modified Cyclodextrin nanosphere/anionic Polymer as Flocculation/Sorption Systems," Journal of Colloid and Interface Science, 283: pp. 406-413 (2005).

Yang, et al., "Sludge Compaction with Ash," pp. 1-3 (2005).

Banerjee, et al., Solubilizing and Detackifying Stickies with B-Cyclodextrin, BioResources 7(2), (2012) 1533-1539.

Japanese Patent Office Action for corresponding Japanese Patent Application No. 2007-555325 dated Jan. 26, 2011(English Translation).

Pizzi, A., Mittal, K.L., Handbook of Adhesive Technology, Second Edition, Revised and Expanded, 2003, pp. 294-295.

Laivins, Gunar V., Scallan, Anthony M., "Removal of Water From Pulps by Pressing: Part 1: Inter-and Intra-Wall Water," Mar. 1994, vol. 77, No. 3, Tappi Journal, pp. 125-131.

Banerjee, Sujit, Howard, Philip H., Lande, Sheldon S., "General Structure-Vapor Pressure Relationships for Organics," Chemosphere, vol. 21, Nos. 10-11, 1990, pp. 1173-1180.

PCT International Preliminary Report on Patentability, Aug. 21, 2007.

PCT Written Opinion of the International Searching Authority, Jul. 27, 2006.

* cited by examiner

METHOD FOR ALTERING THE TACK OF MATERIALS

CROSS REFERENCE TO RELATED APPLICATIONS

This application claims the benefit of U.S. Provisional Application No. 60/653,052, filed Feb. 15, 2005, which is incorporated herein by reference in its entirety.

BACKGROUND OF THE INVENTION

This invention relates generally to methods and compositions for controlling the tack of materials, and more particularly to methods for decreasing the tack of adhesives, pitch, and other particulate, dissolved or colloidal contaminants to minimize deleterious effects of these materials.

In the paper production industry, one area of increasing interest is the reuse of wastepaper; however, the removal of contaminants from the wastepaper or from process streams used to process the wastepaper is key to the ability to reuse this wastepaper. Many contaminants adhere to paper fibers, thereby causing problems during the recycling process. Two such contaminants are known as "stickies" and "pitch." Stickies generally comprise materials originally used as adhesives, including, but not limited to, hot melts, pressure-sensitive adhesives (PSAs), latexes, and binders. Pitch is a natural component associated with both virgin and secondary fibers originating from extractives released from wood during pulping.

Contaminants may cause operational problems during the processing of wastepaper for reuse and may also reduce product quality. Specifically, contaminants may be deposited on wires, felts, press rolls, and drying cylinders of paper machines. In addition, contaminants in the papermaking process may hinder bonding of fibers and increase the frequency of web breaks. Consequently, contaminants must be rigorously controlled in order to improve papermaking operations and product quality.

Tack describes the adhesive property of contaminants. By reducing the tack of contaminants, the propensity of the contaminants to attach to the paper machine wire and other surfaces during processing can be significantly reduced.

Previous methods of reducing the tack of contaminants include both chemical and mechanical treatments of process streams. Some methods focus on the use of repulpable or recyclable adhesives. More common methods include the use of chemical additives to modify or de-tack the contaminants. Often, the chemical additives comprise minerals such as talc. These minerals and surface-active chemicals attach to the surface of the contaminants, thereby altering the surface properties of the contaminants to reduce tack. Unfortunately, however, the use of minerals in detackification presents numerous disadvantages, including a loss of effectiveness when exposed to shear and other operational and product-quality problems. In other approaches, certain polymers and enzymes have been used in efforts to reduce the tack of contaminants; however, their high cost and limited effectiveness make them less desirable.

Mechanical methods for controlling contaminants include dispersion, screening, and cleaning. Dispersion is used to break up the contaminants into smaller and smaller particles until they are invisible in the final product. Unfortunately, even the presence of "invisible" contaminants fails to eliminate sticking of adjacent layers when the product is wound, and these contaminants still can greatly diminish the overall appearance of a product.

Screens and centrifugal cleaners also may be used to remove stickies, pitch, and debris from the fiber stream. Screens physically separate the fiber from the contaminants based on the size and shape differences of the contaminants and the holes or slots in the screen. However, the screens' inability to remove contaminants that are smaller than the screen holes or deformable enough to pass through the screen holes limits the effectiveness of the screens in separating the fiber from the contaminants. Centrifugal cleaners separate the fiber from the contaminants based on the different specific gravities of the contaminants and fibers. Separation is poor, however, when the specific gravities of the contaminants and fibers are similar.

Another method for reducing contaminant tack comprises electrohydraulic discharge, as described for example, in U.S. Pat. No. 6,521,134 to Corcoran et al. and U.S. Pat. No. 6,572,733 to Banerjee et al. This method requires, however, an additional piece of capital equipment with its own operating cost and can substantially increase the cost of processing wastepaper.

Several of the foregoing approaches are described in U.S. Pat. No. 4,781,794 to Moreland, U.S. Pat. No. 6,977,027 to Sharma et al., and U.S. Pat. No. 4,956,051 to Moreland.

While the various different techniques and efforts described above offer some relief to the problems caused by contaminants, contaminant tack still results in substantial operational downtime and a degradation of product quality. Furthermore, this problem is exacerbated by the rising costs caused by the increasing demand for recycled paper, forcing many mills to use lower-grade recycled furnish, which may contain higher levels of contaminants and cause more significant problems in processing. Accordingly, a continuing need exists for a simple and inexpensive method to reduce the tack of contaminants.

SUMMARY OF THE INVENTION

In one aspect, methods are provided for altering the tack of an adhesive material comprising the step of contacting the adhesive material with an amount of a cyclodextrin compound effective to reduce the tack of the adhesive material. The adhesive material may comprise, for example, pitch, pressure sensitive adhesives, hot melts, latexes, binders, and combinations thereof. In a preferred embodiment, this contacting occurs in an aqueous medium, such as one that includes virgin or recycled cellulosic fibers. For instance, the contacting may occur in a process stream of a pulp and paper mill, and the adhesive material may be dissolved or suspended in that process stream. In one case, the cyclodextrin compound is added to a pulper unit. In another case, the cyclodextrin compound may be added to the whitewater. In one embodiment, the cyclodextrin compound may be selected from an α-cyclodextrin compound, a β-cyclodextrin compound, a γ-cyclodextrin compound, derivatives thereof, and combinations thereof. Alternatively, other cyclodextrin compounds may be used.

In another aspect, a method is provided for altering the tack of adhesive contaminants in a process fluid comprising the steps of (i) providing a process fluid in which are dispersed contaminant particles which comprises one or more adhesive materials; and (ii) adding to the process fluid an amount of a cyclodextrin compound effective to reduce the tack of the adhesive material. The process fluid may be in a process stream in a pulp and paper mill. In one embodiment, the concentration of the cyclodextrin compound is between 0.01 and 10 lbs per ton of the particles expressed on a dry solids basis. In another embodiment, the concentration of the cyclodextrin compound is between 0.01 and 10,000 parts per million by volume of the process stream. In an optional embodiment, the method further includes adding to the process fluid at least one additional detackifying agent known in the art, such as a mineral, synthetic or natural chemical, or an enzyme.

In still another aspect, a method is provided for altering the wettability of a surface. The method includes the steps of (i) providing a surface of a material in need of a reduction or avoidance of deposition of adhesive materials; and (ii) contacting the surface with a cyclodextrin compound. For instance, the surface may be constructed of a cellulosic material, a polymeric material, or a metallic material. In a particular embodiment, the surface is part of processing equipment in a pulp and paper mill. In one embodiment, the contacting step includes applying a coating onto the surface.

DETAILED DESCRIPTION OF THE PREFERRED EMBODIMENTS

Methods have been developed for significantly decreasing the tack of adhesive materials where tack is undesirable, such as the case with contaminant particles formed of adhesive materials that need to be treated to avoid deleterious effects on process equipment and products. The need is particularly acute in the use of recycled pulp/paper and products containing recycled paper where the existence of stickies must be managed without incurring significant additional costs. Generally, the methods for altering the tack of an adhesive material comprise the step of contacting the adhesive material with an amount of a cyclodextrin compound effective to reduce the tack of the adhesive material. Advantageously, cyclodextrin compounds are generally significantly less expensive than conventional polymer or enzyme approaches, due for example to the classification of cyclodextrin compounds as a bulk chemical rather than a specialty chemical and the availability of bulk quantities of cyclodextrin compounds from commercial suppliers (such as the Wacker Chemical Company).

In one particular aspect, the methods are used to alter the tack of adhesive contaminants in a process fluid, and comprise the steps of (i) providing a process fluid in which are dispersed contaminant particles which comprises one or more adhesive materials; and (ii) adding to the process fluid an amount of a cyclodextrin compound effective to reduce the tack of the adhesive material. In another aspect, the methods are used for altering the wettability of a surface, and includes the steps of (i) providing a surface of a material in need of a reduction or avoidance of deposition of adhesive materials; and (ii) contacting the surface with a cyclodextrin compound. These methods are particularly useful for decreasing the tack of adhesive contaminants present in paper or in paper mill streams, to improve the control of natural and synthetic adhesive materials (i.e., stickies) in the process and on process equipment.

As used herein, the term "adhesive material" refers to essentially any synthetic or natural adhesive known in the art, including but not limited to synthetic adhesives such as (polymeric) hot melts, pressure-sensitive adhesives (PSAs), latexes, and binders, as well as natural adhesives such as pitch, which originates from wood extractives released during pulping. The adhesive material may be dissolved or suspended (e.g., as macroparticles or microparticles) in a process stream. The adhesive material may be dissolved or suspended in a process stream of a pulp and paper mill.

Figure 1:
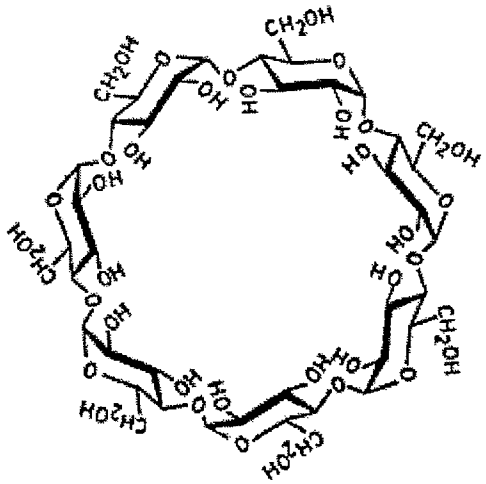
FIG. 1 is an illustration of the structure of a P-cyclodextrin compound.

As used herein, the term "cyclodextrin compound" refers to any compound in the family of oligosaccharides composed of five or more α-D-glycopyranoside units linked 1→4. Typical cyclodextrin compounds comprise between six and eight glucose monomers in a ring; the α-cyclodextrin compound comprising six glucopyranose units, the β-cyclodextrin compound comprising seven glucopyranose units (illustrated in FIG. 1), and the γ-cyclodextrin compound comprising eight glucopyranose units. In preferred embodiments, the cyclodextrin compound may be selected from an α-cyclodextrin compound, a β-cyclodextrin compound, a γ-cyclodextrin compound, derivatives thereof, and combinations thereof.

Although the three naturally occurring cyclodextrin compounds are most common, cyclodextrin compounds comprising as few as five glucopyranose units to as many as 150 member cyclic oligosaccharides have also been identified. Typically, the structure of the cyclodextrin compound comprises a relatively hydrophobic core and hydrophilic exterior. The hydrophilic exterior imparts water solubility to the cyclodextrin compounds and their complexes. The functional groups of cyclodextrin compounds can be derivatized to alter the properties of the cyclodextrin compounds.

The unique structure of cyclodextrin compounds imparts an ability to form complexes with hydrophobic molecules. It is believed this unique structure enables the cyclodextrin compounds to reduce or eliminate the tack of contaminant materials. The unique structure of cyclodextrin compounds utilizes a different mechanism to reduce or eliminate material tack than the chemicals traditionally used. Accordingly, the traditional chemical additives can be used in conjunction with cyclodextrin compounds to reduce or eliminate the tack of a material. Thus, the method for altering the tack of a material may further comprise the step of adding a second chemical to the material, the second material comprising a member selected from the group consisting of minerals, natural chemicals, synthetic chemicals, and enzymes.

In a preferred embodiment of the methods, the contacting step occurs in an aqueous medium. That medium may further include virgin or recycled cellulosic fibers, or a combination of virgin and recycled cellulosic fibers. For instance, the contacting may occur in a process stream of a pulp and paper mill, and the adhesive material may be dissolved or suspended in that process stream. In one case, the cyclodextrin compound is added to a pulper unit. In another case, the cyclodextrin compound is added to the whitewater. In one embodiment, the concentration of the cyclodextrin compound is between 0.01 and 10 lbs per ton of the particles expressed on a dry solids basis. In another embodiment, the concentration of the cyclodextrin compound is between 0.01 and 10,000 parts per million by volume of the process stream. In an optional embodiment, the method further includes adding to the process fluid at least one additional detackifying agent known in the art, such as a mineral, synthetic or natural chemical, or an enzyme.

The cyclodextrin compound can be brought into contact with the adhesive material in any of several different manners and forms. The cyclodextrin compound may be introduced into a fluid containing the adhesive material by itself, or in a dilute or concentrated solution or suspension with a solvent or non-solvent. The one or more cyclodextrin compounds may be combined with a fluid containing the adhesive material in the form of a composition that includes one or more additional components. It may be introduced into the fluid containing the adhesive material in a single point or in multiple points, in a continuous or non-continuous manner. It may, for example, be introduced into a process stream of a pulp and paper mill using a metering pump, or it may be gravity fed.

In another aspect, a method is provided for altering the tack of adhesive contaminants in a process fluid comprising the steps of (i) providing a process fluid in which are dispersed contaminant particles which comprises one or more adhesive materials; and (ii) adding to the process fluid an amount of a cyclodextrin compound effective to reduce the tack of the adhesive material.

In still another aspect, a method is provided for altering the wettability of a surface by treating the surface with a cyclodextrin compound, such as to protect it from deposition or accumulation of unwanted adhesive materials. The method includes the steps of (i) providing a surface of a material in need of a reduction or avoidance of deposition of adhesive materials; and (ii) contacting the surface with a cyclodextrin compound. For instance, the surface may be constructed of a polymer, a cellulosic fiber material, or a metallic material. In a particular embodiment, the surface is part (e.g., the fluid contacting surface) of a piece of processing equipment in a pulp and paper mill. In one embodiment, the contacting step includes applying a coating onto the surface.

The present invention may be further understood with reference to the following non-limiting examples.

Example 1

The effect of a cyclodextrin compound on tack was measured using an adhesive both with and without the addition of a cyclodextrin compound. Cyclodextrin compounds (α- and γ) were obtained from Wacker Chemical Corporation. Carbotac 26207, a typical formulation of a pressure sensitive adhesive, is representative of a family of such adhesives commonly used in the paper industry. These adhesives enter the feedstock through mailing labels, stamps, and other products that are typically attached to a surface through the application of light pressure. They detach from the recycled paper during the repulping operation and enter the process stream.

A 0.1 weight % suspension of Carbotac in water was mixed with a 0.1 weight % suspension of α-, β-, or γ-cyclodextrin compounds in water. A film was prepared by boiling a 500 mL mixture down to 1 mL, placing two small drops on a stainless steel coupon, and spreading the drops into a film. The coupon was kept at room temperature overnight and then dried at 30° C. for 6 hours. The tack of the prepared films was measured at various temperatures with a Polyken tack tester (Testing Machines Inc., Islandia, N.Y.) using a process described by Koskinen, et al., "Sensor for Microstickies" *Tappi J,* 2(4) (2003), which is hereby incorporated by reference. The results were interpolated to 40° C.

The contact angle of a water droplet on the dried surface of the film was also measured. The contact angle is a measure of the hydrophobicity of the surface, a property that can affect the tack of the surface. The contact angle is also a measure of surface wettability; the lower the contact angle, the more wettable the surface.

Table 1 shows the effect of treating pressure sensitive adhesive films with cyclodextrin compounds. The results indicate that the addition of a cyclodextrin compound to a pressure sensitive adhesive film almost completely eliminates tack. Furthermore, the cyclodextrin-treated pressure sensitive adhesive films were easily washed away with water, while the untreated pressure sensitive adhesive films were difficult to remove from the coupons.

The results also indicate that the addition of cyclodextrin to a pressure sensitive adhesive film reduced the contact angle of the surface. Wettability is a contributing factor of tack, and a reduction in the contact angle for cyclodextrin-treated pressure sensitive adhesive films is consistent with a reduced tack of the surface. These results clearly demonstrate the beneficial impact of cyclodextrin compounds in reducing tack, and offer an explanation thereof.

TABLE 1

Tack (g force) and contact angles of cyclodextrin-treated mixtures

| | Film weight ($mg/cm^2$) | Tack (g force) Avg (sd) | Contact Angle (degrees) Avg (sd) |
|---|---|---|---|
| Carbotac | 6.5 | 783 (13) | 80 (2) |
| Carbotac: α-cyclodextrin | 4.9 | 1 (1) | 59 (5) |
| Carbotac: γ-cyclodextrin | 7.9 | 0 (0) | 43 (2) |

Example 2

The ability of cyclodextrin compound derivatives to reduce tack was determined by measuring the tack of an adhesive both with and without the addition of a cyclodextrin compound derivative. Carbotac 26171, another formulation of a pressure sensitive adhesive, is representative of a family of such adhesives commonly used in the paper industry. The following seven cyclodextrin compound derivatives were obtained from Wacker Chemical Corporation: methyl-β-cyclodextrin (A), 2-hydroxypropyl-α-cyclodextrin (B), 2-hydroxypropyl-β-cyclodextrin (C), 2-hydroxypropyl-γ-cyclodextrin (D), α-cyclodextrin (E), β-cyclodextrin (F), and γ-cyclodextrin (G).

One gram of a 0.1 weight % suspension of Carbotac 26171 in water was mixed with different amounts of the cyclodextrin compound solutions (namely A, B, C, D, E, F and G) such that the final concentration of the cyclodextrin compound in the solution was between zero and five percent. One mL of each mixture was placed on a stainless steel coupon, spread into a film, and dried in the oven at 60° C. for 30 minutes to form the film on the surface. The tack of the film was measured at various temperatures using the same method described in Example 1 and interpolated to 40° C.

Table 2 shows the effect of treating pressure sensitive adhesive film with a cyclodextrin compound. The tack of the adhesive film clearly is reduced in the presence of each of the cyclodextrin compounds. Although the amount of cyclodextrin compound required to achieve similar reduced levels of tack differs among the various cyclodextrin compound derivatives, the results clearly indicate that the ability of cyclodextrin compound derivatives to reduce tack was not limited to any one cyclodextrin compound derivative, but was maintained across all cyclodextrin compounds tested.

TABLE 2

| Tack (g force) of cyclodextrin-treated mixtures | | | | |
|---|---|---|---|---|
| | Percent cyclodextrin: | | | |
| | 5% Avg (sd) | 4% Avg (sd) | 3% Avg (sd) | 0 Avg (sd) |
| A | 35 (14) | | 115 (10) | 231 (129) |
| B | 45 (14) | | 120 (26) | |
| C | 31 (14) | | 100 (32) | |
| D | 1 (1) | 31 (9) | 98 (42) | |
| E | 193 (149) | | | 287 (47) |
| F | 0 (0) | 155 (44) | 224 (25) | |
| G | 3 (1) | | 92 (25) | |

Example 3

Atomic Force Microscopy was used to independently verify the results discussed in the preceding examples. Carbotac 26207, a standard adhesive formulation, was applied to stainless steel plates and dried to a smooth film. One plate was briefly dipped into a 3% β-cyclodextrin compound solution and dried. Measurements were made on both the untreated and cyclodextrin-treated films using a conventional atomic force microscope purchased from Asylum Research, Santa Barbara, Calif. Atomic force measurements are made by measuring the deflection of the tip of a probe as it is brought towards and is attracted to the surface to be tested. The deflection of the tip is also measured as it is withdrawn from the surface.

Figure 2:
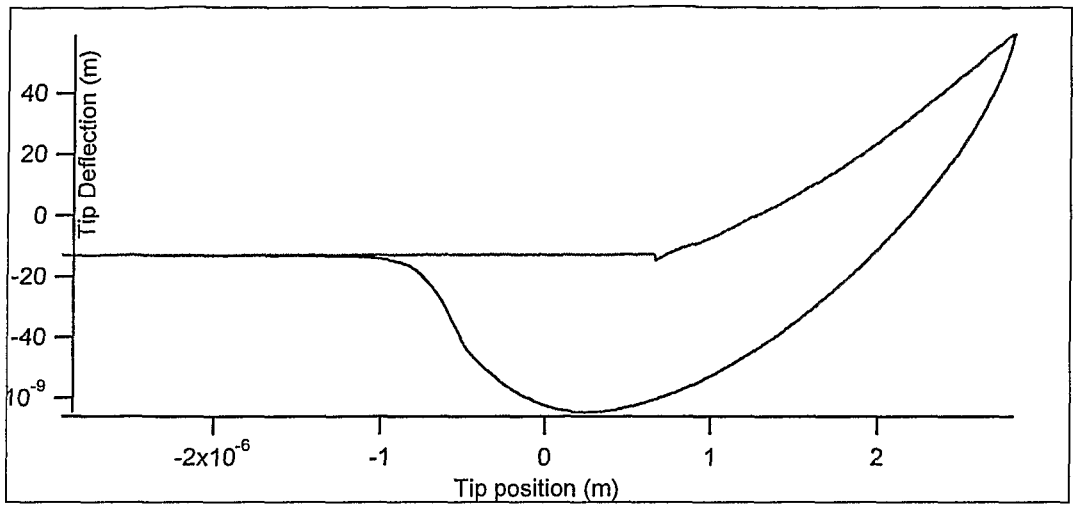
FIG. 2 is an illustration of the deflection of the atomic force microscope tip for a material untreated.

FIG. 2 illustrates the deflection of the untreated sample. The upper curve shows the deflection of the tip as it moves toward the surface and the lower curve is the deflection as the tip moves away from the surface. The two curves are different in shape because the probe tip picks up material from the surface, distorting the release curve.

Figure 3:
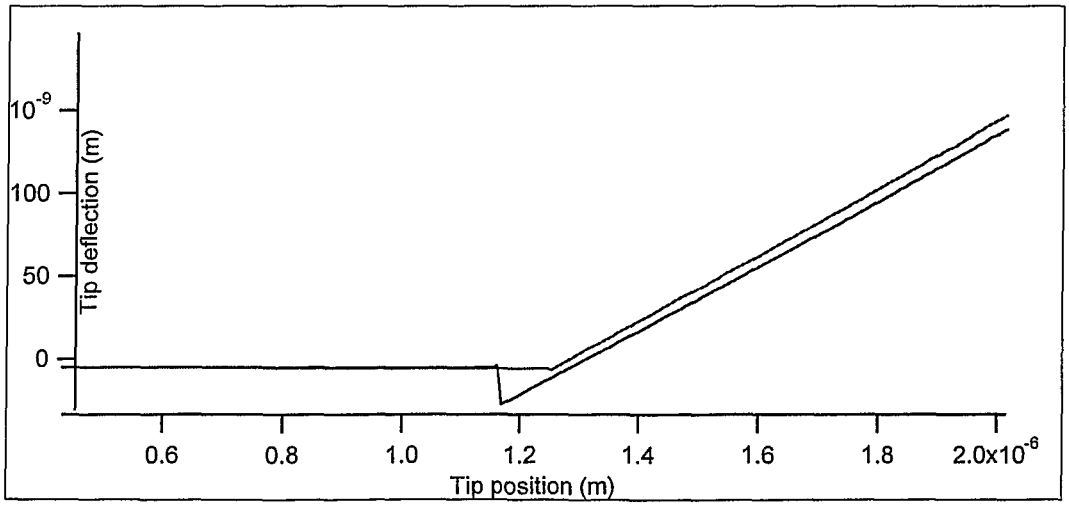
FIG. 3 is an illustration of the deflection of the atomic force microscope tip for a material treated with a cyclodextrin compound.

FIG. 3 illustrates the approach and release curves for the cyclodextrin-treated sample. The upper curve is the approach curve and the lower curve is the release curve. Unlike the untreated sample, the approach and release curves are quite similar in shape because the surface of the treated sample is not sticky and material does not transfer to the tip. These results demonstrate the ability of cyclodextrin compounds to alter the tack of a surface even after formation of a surface film.

Example 4

The effect of the β-cyclodextrin compounds on the behavior of tacky contaminants was determined in a full-scale trial at an operating paper recycling mill. A β-cyclodextrin compound, obtained from Wacker Chemical Corporation, was added to the pulper until a concentration of 50 ppm was reached in the pulper. Process water samples were collected from the primary coarse screen feed in a paper recycling mill, a location early in the process after the repulper. The water samples were dried on a metal coupon and the tack measured using the methods previously described. Two types of furnishes containing different mixtures of newsprint and magazine in the incoming wastepaper were tested.

For one mixture of wastepaper, the tack measurement's baseline value of 104 g force (untreated) was reduced to 20 g force upon treatment with a β-cyclodextrin compound. For the second mixture of wastepaper, the tack measurement's baseline value of 54 g force (untreated) was reduced to zero g force upon treatment with a cyclodextrin compound. These results clearly indicate that the cyclodextrin compound induced a substantial reduction in the tack of components present in the process stream of a full-scale operating paper recycling facility. Importantly, the tack of the material tested does not necessarily derive from only a synthetic adhesive. Wastepaper comprises a plurality of materials including natural and synthetic adhesives and wood pitch. Thus, the results indicate that cyclodextrin compounds effectively reduce the tack of multi-component aggregates.

Publications cited herein are incorporated by reference. Modifications and variations of the methods and devices described herein will be obvious to those skilled in the art from the foregoing detailed description. Such modifications and variations are intended to come within the scope of the appended claims.

I claim:

1. A method for altering the tack of an adhesive material in a process stream of a pulp and paper mill comprising:

adding to a process stream of a pulp and paper mill an amount of at least one cyclodextrin compound effective to reduce the tack of an adhesive material dissolved or suspended in an aqueous media in the process stream, the at least one cyclodextrin compound being in a form capable of forming complexes with the adhesive material, wherein the adhesive material comprises pitch, pressure sensitive adhesives, hot melts, latexes, binders, or a combination thereof, and wherein the at least one cyclodextrin compound is present in a concentration between about 0.01 and 50,000 parts per million by volume of the process stream following said addition.

2. The method of claim 1, wherein the process stream further comprises virgin or recycled cellulosic fibers, or a combination of virgin and recycled cellulosic fibers suspended in the aqueous medium.

3. The method of claim 1, wherein the at least one cyclodextrin compound is added to a pulper unit or to whitewater.

4. The method of claim 1, wherein the at least one cyclodextrin is selected from the group consisting of an α-cyclodextrin compound, a β-cyclodextrin compound, a γ-cyclodextrin compound, methyl-β-cyclodextrin, 2-hydroxypropyl-α-cyclodextrin, 2-hydroxypropyl-β-cyclodextrin, 2-hydroxypropyl-γ-cyclodextrin, and combinations thereof.

5. The method of claim 1, wherein the at least one cyclodextrin compound is present in a concentration between about 0.01 and 50 parts per million.

6. A method for altering the tack of adhesive contaminants in a process fluid comprising:

providing a process fluid in a process stream in a pulp and paper mill in which are dispersed contaminant particles which comprise one or more adhesive materials, wherein the one or more adhesive materials comprise pitch, pressure sensitive adhesives, hot melts, latexes, binders, or a combination thereof; and adding to the process fluid an amount of at least one cyclodextrin compound effective to reduce the tack of the one or more adhesive materials, such that the at least one cyclodextrin compound is present in the process fluid in an concentration between about 0.01 and 50,000 parts per million by volume of the process fluid, the at least one cyclodextrin compound being in a form capable of forming complexes with the adhesive materials.

7. The method of claim 6, wherein the concentration of the at least one cyclodextrin compound is between 0.01 and 10,000 parts per million by volume of the process stream.

8. The method of claim 6, further comprising adding to the process fluid at least one additional detackifying agent.

9. The method of claim 8, wherein the at least one additional detackifying agent comprises a mineral, a synthetic or natural chemical, or an enzyme.

10. The method of claim 6, wherein the at least one cyclodextrin compound is present in a concentration between about 0.01 and 50 parts per million.

11. A method for altering the tack of adhesive contaminants in a process stream of a pulp and paper mill comprising:

providing a process stream of a pulp and paper mill in which are dispersed contaminant particles which comprises one or more adhesive materials; and adding to the process stream an amount of at least one cyclodextrin compound effective to reduce the tack of the one or more adhesive materials, the at least one cyclodextrin compound being in a form capable of forming complexes with the adhesive materials, wherein the at least one cyclodextrin is present in the process stream in a concentration between about 0.01 and 50 parts per million by volume of the process stream.

12. The method of claim 11, wherein the at least one cyclodextrin compound is present in the process stream in a concentration of about 50 ppm.

13. The method of claim 11, wherein the at least one cyclodextrin compound is added to the process stream of a pulper unit.

14. The method of claim 11, wherein the tack of the one or more adhesive materials is reduced by greater than about 80%.

15. The method of claim 11, wherein the tack of the one or more adhesive materials is reduced by about 100%.

* * * * *